United States Patent [19]

Webb, Jr.

[11] 4,091,364

[45] May 23, 1978

[54] COMBUSTION DETECTION DEVICE

[75] Inventor: William Webb, Jr., Denver, Colo.

[73] Assignee: Unitec, Inc., Denver, Colo.

[21] Appl. No.: 623,147

[22] Filed: Oct. 16, 1975

Related U.S. Application Data

[63] Continuation-in-part of Ser. No. 504,489, Sep. 9, 1974, abandoned.

[51] Int. Cl.[2] ..... G08B 21/00

[52] U.S. Cl. ..... 340/237 S; 250/381

[58] Field of Search ..... 340/237 S; 250/381, 250/382, 384, 385

[56] References Cited

U.S. PATENT DOCUMENTS

| | | | |
|---|---|---|---|
| 3,500,368 | 3/1970 | Abe | 340/237 S |
| 3,728,706 | 4/1973 | Tipton et al. | 340/237 S |
| 3,777,423 | 12/1973 | Coulter et al. | 340/237 S X |
| 3,798,625 | 3/1974 | McMillian et al. | 340/237 S |
| 3,866,195 | 2/1975 | Ried, Jr. | 340/237 S |
| 3,913,082 | 10/1975 | Hamm | 340/237 S |
| 3,922,655 | 11/1975 | Lecuyer | 340/237 S |

*Primary Examiner*—John W. Caldwell, Sr.
*Assistant Examiner*—Daniel Myer
*Attorney, Agent, or Firm*—O'Rourke & Harris

[57] ABSTRACT

A combustion detection device that senses the presence of a fire and provides an alarm indication of the same by essentially shorting the input leads from a power supply. An ionization detector is utilized to sense the products of combustion and provide an output indicative thereof, which output is coupled through a field effect transistor to an operational amplifier where the output is compared with a reference voltage that can be varied as desired. When an output from the ionization detector supplied through the field effect transistor exceeds the reference voltage, an output is provided from the operational amplifier to a triggering circuit connected between the power supply leads to essentially short the leads as an alarm indication of a sensed fire condition. A light-emitting diode is connected to the triggering circuit to give a visual alarm indication, and calibration leads are also provided to facilitate calibration of the apparatus. The triggering circuit, in one disclosed embodiment, includes a pair of transistors connected to the drive and sink outputs of the operational amplifier, while in a second disclosed embodiment, the triggering circuit includes a silicon controlled rectifier.

6 Claims, 2 Drawing Figures

COMBUSTION DETECTION DEVICE

RELATED APPLICATION

This application is a continuation-in-part of my copending application, Ser. No. 504,489, entitled "Combustion Detection Device", filed Sept. 9, 1974, and now abandoned.

FIELD OF THE INVENTION

This invention relates to a combustion detection device, and more particularly relates to an apparatus for detecting the presence of fire and providing an alarm indicative thereof.

BACKGROUND OF THE INVENTION

Various types of sensing devices have been developed for monitoring a variety of conditions. One of the more important conditions often monitored is that of combustion in an effort to discover and thus minimize loss due to fire, particularly in buildings or other structures where the presence of a fire could go unnoticed until far too late to minimize loss to any appreciable extent.

Combustion detection devices have heretofore been suggested and/or utilized, but such devices have not proved to be completely satisfactory for all situations due to such diverse factors as being subject to mechanical and/or electrical component failure, vacuum leakage and aging where vacuum tube structures are utilized, and/or being relatively complex and/or of expensive construction so as to be impractical for at least some uses.

A combustion detection device providing pulsed sensing utilizing an ionization detector is shown, for example, in U.S. Pat. No. 3,842,409, entitled, "Ionization Detector Apparatus," issued Oct. 15, 1974 to Ronn H. Mayer and assigned to the assignee of the present invention. The detector of this invention constitutes an alternative to the structure shown and claimed in U.S. Pat. No. 3,842,409.

Various fire detection devices are also shown in U.S. Pat. Nos. 3,795,904 and 3,798,625, while a condition responsive door holder-closer utilizing a radioactive source of americium is shown in U.S. Pat. No. 3,777,423.

SUMMARY OF THE INVENTION

This invention provides an improved combustion detector apparatus that is particularly well suited for providing an alarm indication by essentially shorting the two input leads to the apparatus from a power supply. An ionization detector provides an input to a threshold detector, the output of which triggers a triggering circuit to essentially short the power supply leads when a predetermined output from the ionization detector is exceeded.

It is therefore an object of this invention to provide an improved combustion detection apparatus.

It is another object of this invention to provide an improved combustion detection apparatus suitable for automatically monitoring a location to sense fire conditions.

It is still another object of this invention to provide an improved combustion detection apparatus for providing an alarm condition by essentially shorting the input power supply leads.

It is yet another object of this invention to provide an improved combustion detection device that includes an improved combination of a field effect transistor, an operational amplifier, and a triggering circuit to automatically process a fire condition indication sensed by an ionization detector.

It is still another object of this invention to provide an improved combustion detection apparatus that includes an improved combination of a light-emitting diode in series with a triggering circuit to produce a visual indication of an alarm condition.

It is yet another object of this invention to provide an improved combustion detection apparatus that includes calibration leads to facilitate calibration of the apparatus by external calibration means.

It is still another object of this invention to provide an improved combustion detection apparatus that includes a triggering circuit having a pair of transistors connected with the drive and sink outputs of an operational amplifier to achieve the desired end.

It is yet another object of this invention to provide an improved combustion detection apparatus that includes a triggering circuit having a silicon controlled rectifier connected with the output of an operational amplifier to achieve the desired end.

With these and other objects in view, which will become apparent to one skilled in the art as the description proceeds, this invention resides in the novel construction, combination, and arrangement of parts substantially as hereinafter described and more particularly defined by the appended claims, it being understood that such changes in the precise embodiment of the hereindisclosed invention are meant to be included as come within the scope of the claims.

BRIEF DESCRIPTION OF THE DRAWING

The accompanying drawings illustrate two complete embodiments of the invention according to the best mode so far devised for the practical application of the principles thereof and in which.

DETAILED DESCRIPTION OF THE INVENTION

Figure 1:
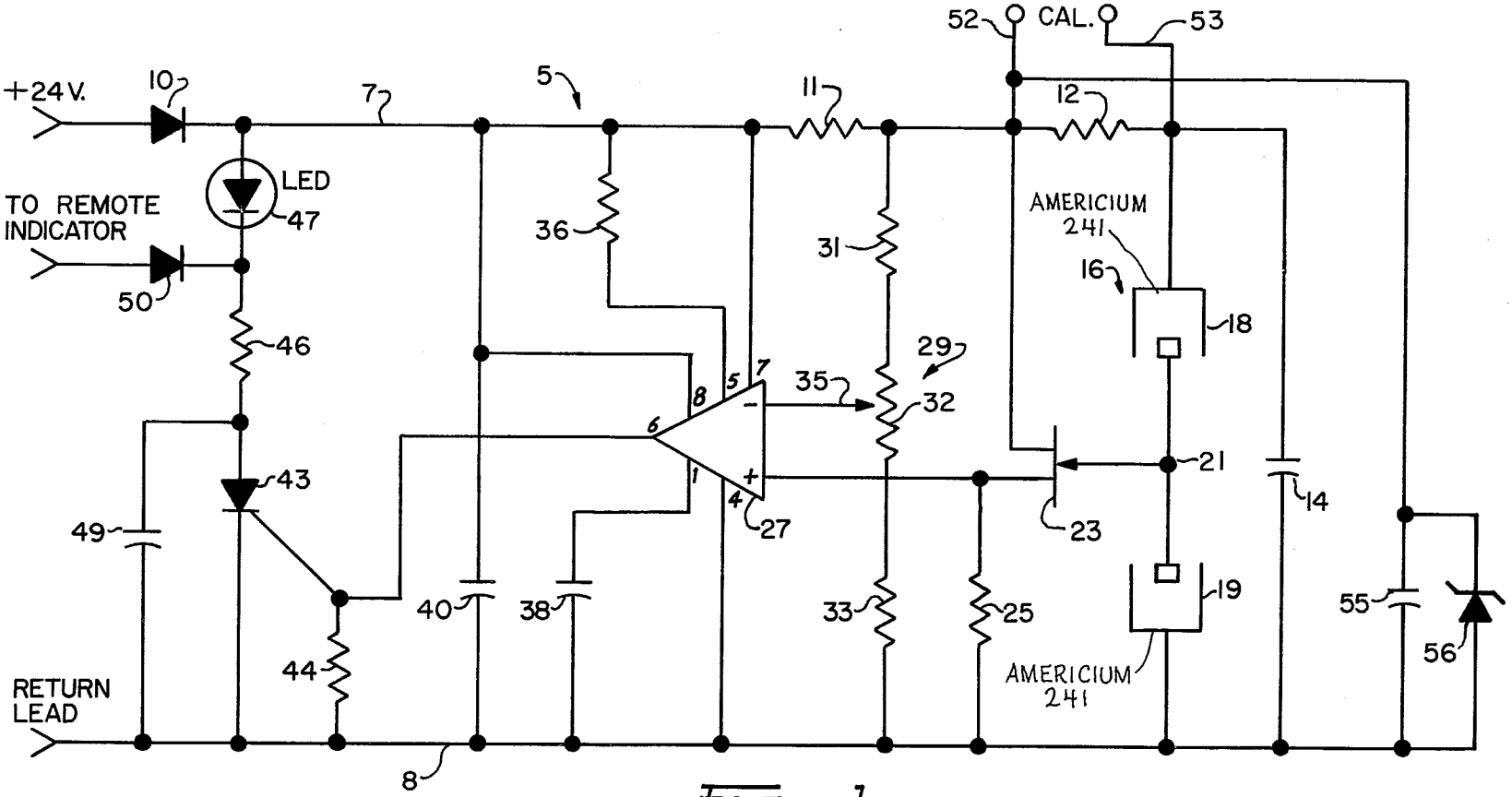
FIG. 1 is an electrical schematic diagram of the combustion detection apparatus of this invention with the triggering circuit shown to include a silicon controlled rectifier.

Referring now to the drawings, the numeral 5 indicates the combustion detection apparatus for the embodiment illustrated in FIG. 1. A pair of leads 7 and 8 are provided, which leads are adapted to be connected with a conventional power supply (not shown) with lead 7 providing +24 volts and lead 8 being a return lead. A diode 10 is connected between the +24-volt power supply (not shown) and lead 7, with lead 7 also being connected with lead 8 through series connected resistors 11 and 12 and capacitor 14.

Ionization detector 16 is connected between leads 7 and 8 and, as indicated in FIG. 1, includes a pair of americium 241 chambers 18 and 19 (radium 226 could be utilized, if desired). Ionization detector 16 senses the products of combustion present in the atmosphere surrounding the detector and provides an output voltage indicative thereof. Americium 241 chamber 18 is preferably substantially closed and, thus, serves as a reference detector while americium 241 chamber 19 is preferably open to sample or monitor the atmosphere surrounding the detector. The output from the detector is taken from the junction 21 between the chambers with the output coupled to the input of field effect transistor (FET) 23. In the absence of a sensed fire condition, i.e., under normal operating conditions, the voltage at junction 21 is about 6 volts.

Field effect transistor 23, which preferably is a JFET type, serves as an amplifier and has the drain electrode connected with lead 7 and the source electrode connected with lead 8 through resistor 25. The output of the field effect transistor 23 is coupled from the source electrode to the positive input of operational amplifier, or comparator, 27, which operational amplifier receives a reference voltage at the negative input from reference voltage supply 29. Reference voltage supply 29 includes resistor 31, potentiometer 32 and resistor 33 connected in series between leads 7 and 8, with the center tap 35 of the potentiometer being connected to the negative input of operational amplifier 27.

Pins 7 and 8 of operational amplifier 27 are directly connected to leads 7, while pin 5 is connected thereto through resistor 36. In addition, pin 4 of operational amplifier 27 is directly connected to lead 8 while pin 1 is connected to lead 8 through capacitor 38, and pin 8 is connected to lead 8 through capacitor 40.

The output from operational amplifier 27 is coupled from pin 6 to the gate electrode of silicon controlled rectifier 43, with pin 6 also being connected to lead 8 through resistor 44. Silicon controlled rectifier 43 has its cathode connected to lead 8 while the anode is connected through resistor 46 (a 10 ohm resistor) and light-emitting diode (LED) 47 to lead 7. In addition, a bypass capacitor 49 is connected between the anode of silicon controlled rectifier 43 and lead 8, and a lead to an external indicator (not shown) is connected to the junction of resistor 46 and LED 47 through diode 50.

Calibration leads 52 and 53 are also provided to facilitate calibration of the apparatus. Lead 52 is connected to lead 7 and to lead 8 through parallel connected capacitor 55 and zener diode 56, while the lead 53 is directly connected to americium 241 chamber 18 of ionization detector 16.

The following is a listing of components that have been utilized in a working embodiment of the invention as shown in FIG. 1, it being understood that such listing is for illustrative purposes only and the invention is not meant to be limited thereto:

| | |
|---|---|
| Diodes 10 and 50 | 1N4004 |
| Zener Diode 56 | 2N759B (12v) |
| LED 47 | Red Lite 4 |
| JFET 23 | 2N4117A |
| Comparator 27 | CA 3094 |
| SCR 43 | 2N 5061 |
| Resistors (ohms) 11,12 and 25, | 47K |
| 36 | 1M |
| 31 | 2.2M |
| 33 | 2.7M |
| 44 | 100 |
| 46 | 10 |
| Potentiometer 32 | 0—1M ohms |
| Capacitors (μFd) 14, 38, 49 and 55 | 0.1 |
| 40 | 47 |

In operation, the apparatus is preferably initially calibrated by connection of leads 52 and 53 to an external calibration means and then setting potentiometer 32 to the particular threshold desired, normally about 7.2 volts, for example. The apparatus is then placed in any convenient position where continuous monitoring is desired for products of combustion, i.e., to sense the presence of a fire.

When no fire is sensed, the output from the ionization detector will be such that the field effect transistor is maintained in a conductive state, but the output voltage is maintained below the setting of the reference voltage supplied to the negative input to the comparator (operational amplifier 27) so that the comparator will therefore provide no output to the silicon controlled rectifier and, hence, no alarm will be energized.

When a fire is sensed by the apparatus, however, the output from the ionization detector will increase to the extent that the field effect transistor supplies a sufficient voltage so that an output will be coupled from comparator 27, such a voltage, of course, exceeds the reference voltage supplied from potentiometer 32 to the comparator negative input. When the output thus exceeds the reference voltage supplied to the comparator, comparator 27 will then provide an output to silicon controlled rectifier 43 to trigger the rectifier. When the SCR 43 fires, a short will be essentially developed across the power supply leads 7 and 8 through resistor 46 and LED 47 to indicate an alarm condition, and the light-emitting diode 47 will be energized. Silicon controlled rectifier 43 will remain energized to thus continuously indicate an alarm condition until the power is removed and later reapplied after ionization detector 16 no longer senses a product of combustion indicative of a fire. A virtual short across the power supply leads 7 and 8 can be reflected in remote equipment, for example, or at a control point, to give an alarm condition in conventional fashion to an operator.

Figure 2:
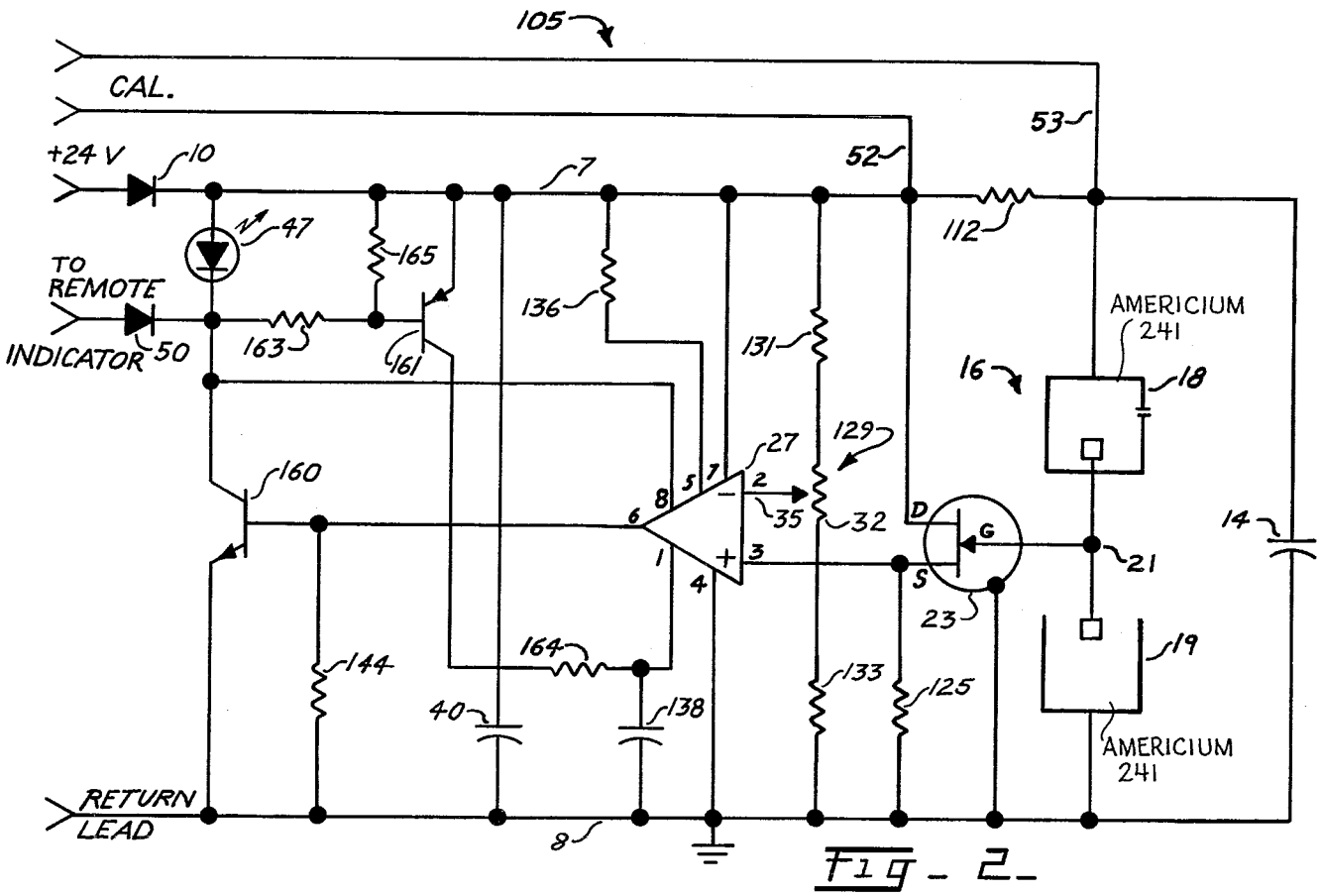
FIG. 2 is an electrical schematic diagram of the preferred embodiment of the combustion detection apparatus of this invention with the triggering circuit shown to include a pair of transistors.

FIG. 2 shows the preferred embodiment 105 of the invention. The two disclosed embodiments utilize similar components, and where utilized, have been identified by the same reference numerals. For example, leads 7 and 8 have ionization detector 16 connected therebetween with the junction 21 between americium chambers 18 and 19 being connected to the input of field effect transistor 23. In like manner, the output of the field effect transistor 23 is coupled from the source electrode to the positive input of operational amplifier 27, which amplifier receives a negative input from a reference voltage supply (identified as 129).

The values of resistors 112 (connected with line 7), resistor 125 (connected to the source electrode of FET 23), and resistors 131 and 133 (in the reference voltage supply) are, however, unlike the values of resistors 12, 25, 31 and 33, and accordingly, have been given new numerals as shown in FIG. 2.

As also shown in FIG. 2, operational amplifier 27 is connected to a triggering circuit which includes a pair of transistors 160 and 161 with transistor 160 having its base connected to the drive output (pin 6) and its collector connected to the sink output (pin 8) of operational amplifier 27. As also shown in FIG. 2, the base of transistor 161 is connected to the sink output (pin 8) of operational amplifier 27 through resistor 163 and the collector of transistor 161 is connected to the inhibit input (pin 1) of operational amplifier 27 through resistor 164. The emitter of transistor 160 is directly connected to return lead 8, while the base of transistor 160 is connected to return lead 8 through resistor 144. The emitter of transistor 161 is directly connected with power supply lead 7 while the base of transistor 161 is connected with power supply lead 7 through resistor 165. In addition, pin 1 of operational amplifier 27 is connected with return lead 8 through capacitor 138 and pin 5 of operational amplifier 27 is connected with power supply lead 7 through resistor 136.

The following is a listing of components (in addition to like identified components in FIG. 1 as identified hereinabove) that have been utilized in a working embodiment of the preferred form of this invention, it being understood that such listing is for illustrative purposes only and the invention is not meant to be limited thereto:

| | |
|---|---|
| Resistors (ohms) 112, 144, and 165, | 10 |
| 125 and 133, | 1.2M |
| 131 | 470K |
| 136 | 10M |
| 163 | 360 |
| 164 | 1M |
| Capacitor (μFd) 138 | 1 |
| Transistors 160 | 2N2222 |
| 161 | 2N2907 |

The operation of the invention as shown in FIG. 2 is similar to that of FIG. 1 except that the triggering circuit includes transistors 160 and 161 connected to the outputs of operational amplifier 27 with the collector of transistor 161 being coupled to pin 1 (of the operational amplifier) through a Darlington output (that includes pins 1, 6 and 8).

With no fire sensed, the output from the ionization detector will be such as to maintain the field effect transistor in a conductive state while providing an output voltage to operational amplifier 27 less than that of the reference voltage output so that transistor 160 is maintained in a nonconductive state which results in a no alarm condition.

When a fire is sensed, however, the output from the ionization detector increases as does the output from the field effect transistor. When the output from the field effect transistor exceeds the reference voltage at the operational amplifier, an output is provided by the operational amplifier to cause transistor 160 to conduct and this essentially shorts the leads 7 and 8 through LED 47 and transistor 160 connected in series across leads 7 and 8. When transistor 160 conducts, transistor 161 starts to conduct and transistor 161 is connected to operational amplifier 27 so that transistors 160 and 161 will remain conductive until power to the apparatus is discontinued. After the condition causing the alarm has been corrected, the apparatus will produce no output when power is reapplied until a condition again exists causing an output to be produced by the operational amplifier.

In view of the foregoing, it is to be realized that the combustion detector apparatus of this invention provides an improved device that is particularly well suited for continuous monitoring to sense products of combustion indicative of the presence of a fire.

What is claimed is:

1. A combustion detection apparatus, comprising:

ionization detection means including first and second americium 241 chambers, one of which is open to the atmosphere and the other of which is substantially closed, said chambers being connected so that said ionization detection means provides an output voltage that varies depending upon sensed products of combustion in the atmosphere surrounding said open chamber;

a reference voltage source providing a reference voltage output;

comparator means for receiving said output from said ionization detection means and said reference voltage output, said comparator means having an inhibit input, a drive output and a sink output and providing an output if the output from said ionization detection means exceeds said reference voltage output from said reference voltage source;

trigger means including first and second interconnected normally nonconductive transistors one of which is connected with said comparator means to receive said drive output therefrom and the other of which is connected with said inhibit input of said comparator means whereby said transistors are caused to become conductive upon receiving an output from said comparator means; and alarm indicating means connected with said trigger means and, responsive to said transistors becoming conductive, causing and maintaining an alarm indication; and means for receiving said alarm indication from said trigger means and indicating an alarm condition.

2. A combustion detection apparatus, comprising:

ionization detection means providing an output indicative of products of combustion sensed by said detection means;

a pair of input leads adapted to be connected to a power supply;

a reference voltage source providing a reference voltage output;

comparator means for receiving said output from said ionization detection means and said reference voltage output, said comparator means having an inhibit input and drive and sink outputs with said comparator means providing an output if the output from said ionization detection means exceeds said reference voltage received from said reference voltage source;

trigger means including first and second normally nonconductive semi-conductor means one of which is connected with said comparator means to receive said drive output therefrom and the other of which is connected with said inhibit input of said comparator means whereby said semi-conductor means are caused to become conductive upon receiving an output from said comparator means; and connecting means for connecting said semi-conductor means between said two input leads to essentially short the same upon receipt of a signal from said comparator means to thereby achieve sensing of a fire by said apparatus whereby said sensed fire can be indicated by an alarm indicating device when so connected with said two wires.

3. The combustion detection apparatus of claim 2 wherein said apparatus also includes calibration enabling means connected with said ionization detection means whereby calibration of said apparatus is facilitated.

4. The combustion detection apparatus of claim 2 wherein said semi-conductor means has a light-emitting diode in series therewith between said leads of said power supply.

5. A combustion detection apparatus, comprising:

a pair of input leads adapted to be connected to a power supply;

an ionization detector providing an output indicative of products of combustion sensed by said ionization detector;

a field effect transistor connected to said ionization detector to receive the output therefrom;

a reference voltage supply means connected between said input leads;

an operational amplifier having amplifier bias, differential voltage, and inhibit inputs and drive and sink outputs, said output from said field effect transistor being coupled to said amplifier bias input and said reference voltage being coupled to said differential voltage input, said operational amplifier producing an output if said input from said field effect transistor exceeds that of said reference voltage;

a light-emitting diode; and a pair of normally nonconductive transistors one of which is connected in series with said light-emitting diode between said input leads and to the outputs of said operational amplifier, and the other of which transistors is connected to said sink output and said inhibit input of said operational amplifier whereby said transistors are caused to become conductive upon receiving an output from said operational amplifier indicative of products of combustion sensed by said ionization detector to essentially short said input leads to thus indicate and maintain said indication of a fire sensed by said ionization detector.

6. The combustion detection apparatus of claim 5 wherein said ionization detector includes a pair of americium 241 chambers connected to said power supply leads.

* * * * *